US008978690B2

(12) United States Patent
Hubbard, Sr. et al.

(10) Patent No.: US 8,978,690 B2
(45) Date of Patent: Mar. 17, 2015

(54) AUTOMATIC PURGING DEVICE FOR AC CONDENSATION DRAIN LINES

(71) Applicant: Safe-T-Flush Corp, Tequesta, FL (US)

(72) Inventors: Austin J. Hubbard, Sr., Palm Beach Gardens, FL (US); Louisa E. Winter, Tequesta, FL (US)

(73) Assignee: Safe-T-Flush Corp, Tequesta, FL (US)

( * ) Notice: Subject to any disclaimer, the term of this patent is extended or adjusted under 35 U.S.C. 154(b) by 76 days.

(21) Appl. No.: 13/897,133

(22) Filed: May 17, 2013

(65) Prior Publication Data

US 2013/0306163 A1 Nov. 21, 2013

Related U.S. Application Data

(60) Provisional application No. 61/648,812, filed on May 18, 2012.

(51) Int. Cl.

| | |
|---|---|
| ***B08B 9/032*** | (2006.01) |
| ***B08B 5/02*** | (2006.01) |
| ***F28F 17/00*** | (2006.01) |
| ***F24F 13/22*** | (2006.01) |

(52) U.S. Cl.

CPC ..... *B08B 5/02* (2013.01); *B08B 9/0328* (2013.01); *F28F 17/005* (2013.01); *F24F 13/222* (2013.01)

USPC ..... 137/240; 137/209; 137/409; 137/557

(58) Field of Classification Search

USPC ..... 137/237, 240, 312, 209, 212, 393, 398, 137/409, 430, 432, 429, 557

See application file for complete search history.

(56) References Cited

U.S. PATENT DOCUMENTS

| | | | | |
|---|---|---|---|---|
| 4,793,016 | A * | 12/1988 | Valentine et al. | 137/268 |
| 5,530,988 | A | 7/1996 | McQuillan | |
| 5,666,690 | A | 9/1997 | Domansky | |
| 5,996,597 | A | 12/1999 | Gallo | |
| 6,041,611 | A | 3/2000 | Palmer | |
| 6,427,458 | B1 | 8/2002 | Fowler | |
| 6,443,173 | B1 * | 9/2002 | Thompson, Jr. | 137/204 |
| 7,686,034 | B1 | 3/2010 | Coogle | |
| 7,857,004 | B2 | 12/2010 | Pearson | |
| 7,930,898 | B2 | 4/2011 | Laufenberg et al. | |
| 8,156,956 | B1 * | 4/2012 | Coogle | 137/240 |
| 2006/0042292 | A1 | 3/2006 | Kimbrough et al. | |
| 2011/0061745 | A1 | 3/2011 | Pearson | |
| 2014/0130529 | A1 * | 5/2014 | Kaiser et al. | 62/150 |

* cited by examiner

*Primary Examiner* — Kevin Lee
(74) *Attorney, Agent, or Firm* — McHale & Slavin, P.A.

(57) ABSTRACT

An automatic condensate line purging device for HVAC condensation lines using pressurized gas. The purging device is installed in the condensate drain line of an air conditioning system allowing condensate flow through the device during normal operation where no clog has occurred in the condensate drain line. Should the drain line become clogged, a plug is displaced to seal the condensate drain causing the condensate to back-up up into the external condensate drain pan located beneath the condenser of conventional HVAC systems. When the drain pan fills with water, the safety float switch used to shut down the air conditioner is coupled to a solenoid valve mounted on the purging device wherein a charge of gas is directed into the drain line for removal of the clog.

15 Claims, 2 Drawing Sheets

AUTOMATIC PURGING DEVICE FOR AC CONDENSATION DRAIN LINES

PRIORITY CLAIM

This application is based upon and claims the priority date of U.S. Provisional Patent Application No. 61/648,812, entitled "AUTOMATIC PURGING DEVICE FOR AC CONDENSATION DRAIN LINES", filed May 18, 2012, the contents of which is incorporated herein by reference.

FIELD OF THE INVENTION

This invention relates to the field of HVAC equipment and in particular to an automatic purging device for use with AC condensate drain lines.

BACKGROUND OF THE INVENTION

Conventional air conditioner systems utilize a drain pan for collection and removal of condensation. Condensation is the water formed on the evaporator coil during the air conditioning process. A drain pan is situated below the evaporator coil to collect the condensate and direct the condensate fluid to a drain, via a condensate drain line. Unfortunately, over a period of time the drain line may become clogged due to algae, fungus, airborne debris entering the line, house settling, and so forth. If a drain line clogs, the drain pan will fill wherein a properly positioned safety float switch is used to shut off the air conditioning unit thereby stopping the process and further production of water. The occupant of the premise will understand that the air conditioner is not working resulting in a call to an AC specialist. The timing of a clogged drain line cannot be predicted, but happenstance typically calls for the failure to occur at the least convenient time for the occupant. The need for a proper drain line is most important during warm weather conditions which coincide with the highest air conditioner use. Unfortunately HVAC service people are typically the busiest at such time, reducing the possibility of a timely service call which can aggravate an already unpleasant experience.

A clogged condensation line can be cleared by cutting open the line and pressurized water or air is flushed through the drain line to remove the clog. If the pressurized line is not properly installed leakage can occur right at the point of entry. A p-trap may have been installed allowing the repair from a particular area, however, in many instances the p-trap is the location of the clog. A low pressure flush may be inadequate and a high pressure flush may rupture the drain lines. Condensate drain lines are typically constructed of white PVC which is easy to assemble and acceptable to most code regulations.

Drain lines can be unclogged using various techniques including vacuum, pressurized water, pressurized air, line replacement and so forth. Devices are also known to provide for an automated cleaning or purging of the blocked drain lines.

U.S. Publication No. 2011/0061745 discloses an automated condensate drain line cleaning apparatus. The fluid flow regulation device may be electrically coupled with the controller to receive at least one control signal from the controller. The fluid flow regulation device may cause a fluid to flow into a condensate drain line through the fluid supply line responsive to at least one control signal.

U.S. Pat. No. 7,930,898 discloses an air conditioning drain device comprising a tubular pipe assembly, a flapper assembly, and a service port assembly. The device automatically engages a flapper valve that prevents the reverse flow of condensate water, and provides a unidirectional pressure valve that can receive pressurized gas or liquid to dislodge a blockage.

U.S. Pat. No. 7,857,004 discloses a vehicle based condensate drain line cleaning apparatus. The apparatus includes a controller, a fluid supply line, and at least one fluid flow regulation device.

U.S. Pat. No. 5,530,988 discloses a device for unclogging pipes having a canister adapted to receive a pressurized gas, the canister adapted to the pipe or line that is to be unclogged. A method and device for providing an additive, such as a cleaning product, to a tank or line is also disclosed.

U.S. Pat. No. 5,666,690 discloses a device for purging HVAC condensation lines. A body is adapted to contain a conventional gas cylinder such as a 12 gram $CO_2$ cylinder. The body is adapted to connect to a nozzle which in turn is connected to a connector that is attached to the condensation line. The body is rotated onto the nozzle in a manner that controllably releases gas pressure from the gas cylinder into the condensation line so as to cause a pressure buildup that purges the condensation line.

U.S. Pat. No. 5,996,597 discloses a miniature gas cylinder for use in cleaning of a drain line. A control housing includes a cartridge housing portion for attaching a cartridge, containing a pressurized gaseous medium and preferably either a drain cleaning or algaecide fluid, thereto with an interior of the cartridge opening into the internal passage.

U.S. Pat. No. 6,041,611 discloses a system for cleaning out a condensate drain line. The system comprises a manifold operatively placed in fluid communication with the condensate drain line. The manifold includes a first, second, and third line. In one embodiment, the first line extends from the manifold, and the second and third line are axially aligned with the condensate drain line. A water stream, which is operatively connected with the first line, is provided so that the water stream may be channeled through the manifold and into the condensate drain line. The manifold may further comprise a fourth line extending from the center of the manifold, with the fourth line having a fourth valve disposed therein. The system may employ a pan sensor for measuring the level of condensation within the secondary pan and activating an alarm once a predetermined level is reached.

U.S. Pat. No. 6,427,458 discloses a device to clear a blockage from a drain line draining condensation from an air handler in an air conditioner. A pump with check valves attaches to one end of a drain line which drains condensation from an air handler. A handle on the pump is used to create respectively a vacuum or pressure within the pump which is communicated to the drain line. When sufficient vacuum or pressure is created, it will dislodge a blockage in the drain line allowing the drain line to naturally drain. A valve is placed at one end of the pump which allows accumulated liquid in a collection pan to be pumped from the collection pan in the process of clearing condensation from the air handler.

U.S. Pat. No. 7,686,034 discloses an apparatus that applies chemicals to condensate water from an air conditioning condensate tray. It has an elongate body and a central cavity enclosed by an encircling wall. The central cavity receives chemicals to prevent the growth of microorganisms. A first tubular member is operatively connected at a first end to an aperture in the wall, and a second end extending outwardly for receiving condensate water from the condensate tray. A second tubular member is operatively connected to a second aperture in the wall opposite the first aperture aligned with the first member so that a cleaning brush may be passed through both members and into the condensate tray. Below the two tubular members a fluid outlet is provided with a connector for joining to a drainage system for draining the chemically treated condensate water from the cavity.

U.S. Publication No. 2006/0042292 discloses a method of removing microbial and bacterial growth inside a blocked HVAC condensate drain line using compressed air without cutting into or disassembling the drain line.

What is lacking in the art is an automatic drain line using replaceable gas cylinders that provides an automatic seal and directional purging of the condensate drain line.

SUMMARY OF THE INVENTION

The present invention is an automatic in-line device for purging HVAC condensation lines by use of a gas discharge. The device consists of a housing that is placed in the PVC drain line. During normal operation where no clog has occurred the condensate will flow through the body to drain. Should the drain line become clogged, a float ball will be displaced to plug the drain line by use of the condensate as it fills the condensate drain pan. Once the drain pan is filled, a safety float switch is used to shut down the air conditioner and activate a solenoid valve mounted on the housing which is constructed and arranged to deliver a burst of pressurized gas into the drain line to remove the clog. It should be noted that upon discharge of the gas, the float ball will be tightly sealed so that the gas discharge is directed toward the clog in the drain line. Upon discharge of the gas and removal of the clog, water from the drain pan will now flow through the drain pipe further removing remnants of the clog. When the drain clears, the safety switch opens and the AC unit returns to normal operation.

An objective of the invention is to provide an automatic and reliable device for purging condensation lines by use of a disposable gas canister.

Yet still another objective of the invention is to provide a purging device which allows condensation lines to be purged without the attendance of professional HVAC personnel.

Still another objective of the invention is to provide a device that employs conventional and disposable gas cylinders that can be easily replaced by the consumer.

Still another objective of the invention is to provide a device for purging condensation lines which present minimal risk of further damage to the premises or to the drain lines.

Yet still another objective of the invention is to provide a device that provides a method of cleaning smaller drain lines when needed to avoid line replacement.

Still another objective of the invention is to provide a device that can clear drain lines have poor draining characteristics due to excessive bends, lack of proper fluid slope, or the like.

Another objective of the invention is to provide a device that can automatically clear p-traps without opening of the drain line.

Other objectives and advantages of this invention will become apparent from the following description taken in conjunction with the accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Figure 1:
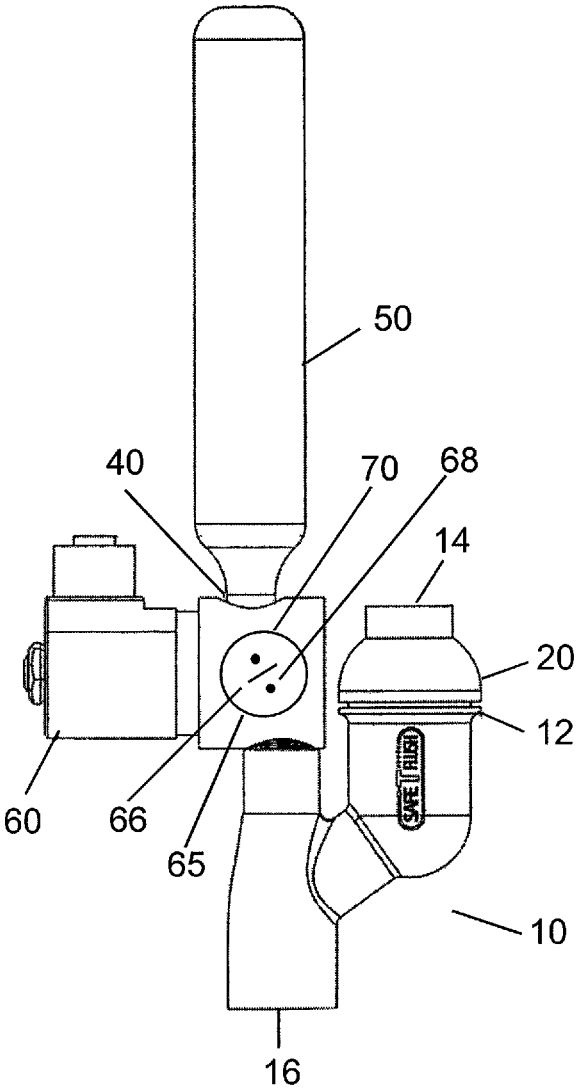
FIG. 1 is a side view of the instant invention.
Figure 2:
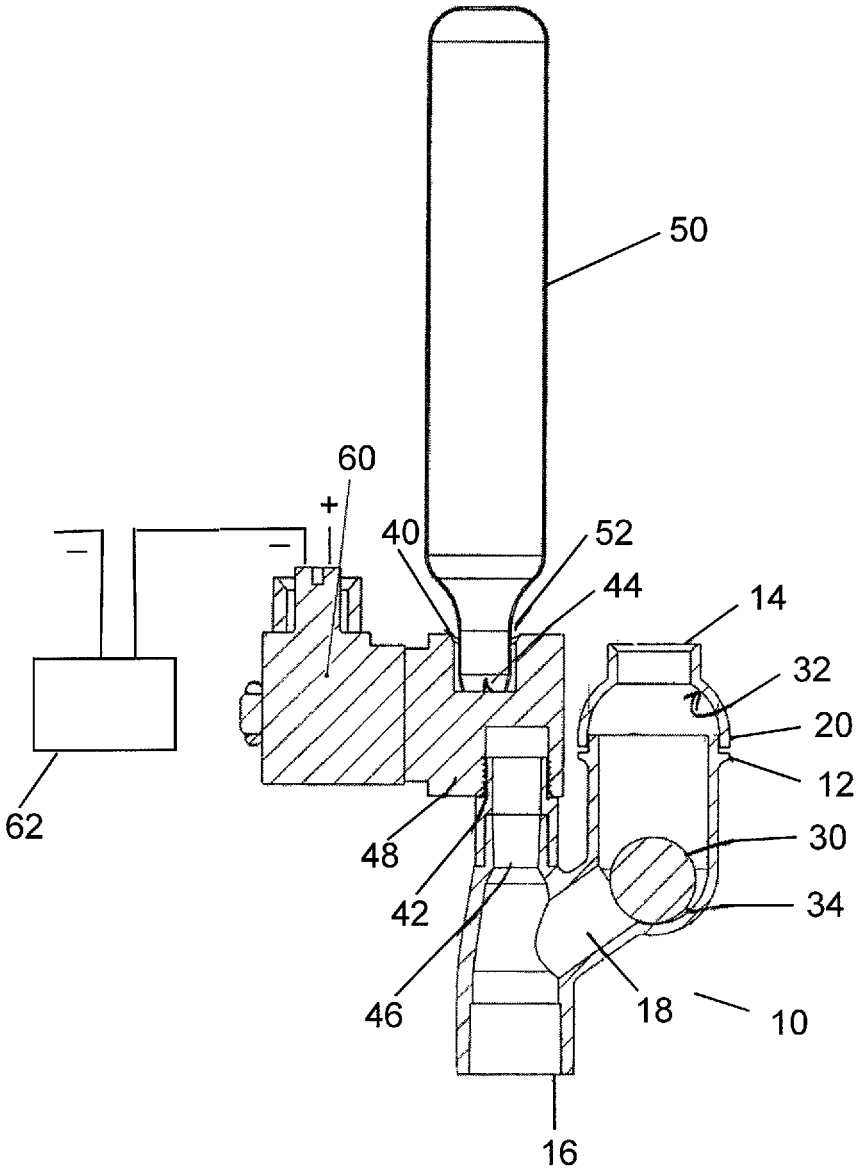
FIG. 2 is a cross sectional side view of FIG. 1.

Now referring to the figures in general, set forth is the automatic in-line condensate drain purge device 10 of the instant invention. The device consists of a flow through housing 12 having a condensate inlet 14 and an outlet 16. The condensate inlet 14 is fluidly connected to the outlet 16 by a chamber 18 which allows normal condensate draining from the condensate inlet 14 to the outlet 16. The housing 12 is placed in-line with a new or preexisting condensate drain line. HVAC systems are heavily regulated and conventional code requires the air conditioner drain line to be white PVC pipe, the housing 12 is preferably made out PVC with the condensate inlet 14 and outlet 16 sized for an in-line direct coupling to the drain line allowing ease of installation. While glued PVC is preferable, the housing may also be threaded for compatibility. Further, the housing may have a threaded inlet and outlet wherein a PVC adapter may be employed to couple the threaded housing to a PVC pipe for glue weldment.

The housing can be formed from a single piece or from multiple pieces that are fastened together. The condensate inlet 14 and outlet 16 can be of most any diameter, a ¾ inch diameter pipe is the most common size used for drain lines. Since the drain line is limited in slope, the condensate will drain slowly causing even the large lines to have drainage problems. In particular, it is commonly known that the drain lines flow so slowly that they are susceptible to clogging and for this reason an oversize drain line is thought to be the answer, however, any bend or slope issue can reduce the effectiveness of larger pipe. It is well known in the HVAC industry that most every drain line will clog as the flow rate is so slow and consists of water propone to bacterial growth. It is also known that poor installation techniques such as using smaller drain lines, multiple bends, or not accommodating a proper slope will cause some drain lines to clog sooner than others.

The instant invention can work on any size pipe, wherein the condensate inlet 14 and outlet 16 can be sized accordingly to the drain line. The condensate inlet 14 includes removable cap 20 that is attached onto a receptacle 22 of the housing 12, with the use of threads, engagement tabs 24, or the like attachment mechanism. An O-ring, not shown can be used to seal the cap 20 to the housing 12. The cap 20 is used to allow installation of a spherical float ball 30 or the like device capable of providing a plug in the condensate drain line to create a seal. The float ball 30 is used to seal the condensate inlet 14 should water back up through outlet 16. The use of spherical shaped ball allows for ease of sealing on the inner surface 32 of the cap 20. The float ball can be made of most any buoyant material such as plastic, ceramic, rubber or combinations thereof. The purpose of the floating plug, in the preferred embodiment a spherical shaped ball, is to provide an automatic sealing device to assure the pressurized gas to be released flows outward through the drain line to remove the clog. The result is a large rush of water, now pressurized, flows through the line in such a volume so as to create a turbulent flow scouring the lining of the pipe to provide a flushing of the pipe and associated clog removal. It should be noted that while the float is in the shape of a ball as a preferred embodiment, most any type of plug or the like float mechanism may operate, including different ways of sealing. For instance, the use of an O-ring may be employed to provide a seal between the cap 20 and housing 12 or provide an interference fit between the float ball 30, wherein a rigid ball, such as a femoral plastic, may engage the seal by the O-ring seal. The deformity of the O-ring seal would be sufficient to provide a seal and mechanism. Still another example would be the use of a floating ball having a soft outer skin, such as a plastic ball over molded with rubber, or an all rubber ball having buoyancy. Another example would be the use of a flapper valve that can be formed within the cap 20, not shown, which simply allows fluid to flow in a singular direction.

The preferred embodiment employs the use of a floating ball 30. The cap 20 can be removed and the ball cleaned and properly situated within a retainer seat 34, wherein maintenance personnel can perform an inspection of the device and note that if the sealing surfaces are clean and available for drain discharge. The removal of the cap 20 will also provide an indication of the drain line condition as the fluid chamber 18 provides a bend so maintenance personnel will be able to detect slow drainage by any film that builds up along the fluid chamber 18.

A gas inlet 40 is in communication with the outlet 16 by use of a piercing tube 42 having proximal end mounted pin 44 for use in piercing a pressurized gas cylinder 50 and distal end 46. In a preferred embodiment, the piercing tube 42 is separated from the flow chamber 18 by use of an enclosure wall 48. The gas inlet 40 receptive to a gas cylinder 50 preferably having a threaded end that engages reciprocal threads on the gas inlet 40. In a preferred embodiment, a 3.2 oz (88 gram) CO2 cylinder is employed. The cylinder having sufficient capacity to discharge gas at a high rate with sufficient volume so as to remove a clog from most any drain line and provide a continuous pressurized gas flow to assure flushing of the clog through exhaustion of the cylinder gas. The $CO_2$ cylinder is readily available and low cost although most any type of gas may be employed. For instance, $N_2$ gas using a similar sized cylinder is known as well as well as straight compressed air. In addition, in many instances pressurized gases may be available wherein the cylinder may be replaced with attachment to a pneumatic gas source capable of providing a pressurized source.

Various commercial sized cylinders are also known to exist from very small 12-16 gram disposable cylinders to larger cylinders that can be refilled. The preferred cylinder is 88 grams which is commonly available, low cost, and sufficient to allow a clean discharge of the drain lines. In addition, the 88 gram cylinder is lightweight wherein the housing and cylinder may be placed in-line without the need for additional support. A smaller cylinder could be used in installations where a small condensate drain line has been employed. For instance, a small air conditioner system found in a residential condominium might employ a inch line wherein as 12 gram cylinder is sufficient. Similarly, larger commercial installations having longer drain line runs may employ a larger cylinder or tee a couple of independent systems together, wherein the gas cylinder is remotely mounted for servicing multiple condensate drain lines.

A solenoid 60 is coupled to the housing 12 and operatively associated with the cylinder 50, so as to control discharge of the cylinder only upon initiation of a solenoid coil. The solenoid 60 includes a coil that is electrically coupled to a safety shut off switch pan float switch 62 commonly found in the emergency condensate drain pan, wherein a normally closed switch allows the power to an air conditioner controller when the drain pan is empty. A normally open position is used to disconnect the air conditioner and at the same time provide power to the solenoid coil for operation to release gas from the cylinder 50 through the piercing tube 42 and to the drain line attached to outlet 16. It is noted that for the safety switch 64 to operate, the drain pan would need to be filled with water which means the condensate has backed up through the float chamber 18, causing the float ball 30 to rise and seal fluid from backing through the condensate inlet 14. Upon discharge of the gas, the chamber within the housing 12 will be pressurized, further forcing the ball 30 against the inner surface 32 of the cap 20, with the remaining pressure causing a burst of water pressurized by the discharge of the gas cylinder to go down through the drain line until the gas cylinder is completely exhausted. Upon discharge of the gas cylinder 50, the clog will be removed and with pressure released from the fluid chamber 18, the ball 30 will reset into the seat 34 allowing the water from the drain pan to flow through the inlet 14 across flow chamber 18 and out the outlet 16 in a good volume so as to further cause any debris from the clog to be flushed to the drain. The purge device may include an indicator 66 to notify when the gas canister is empty 68 or filled 70. The indicator 66 may be a pressure gauge 65 having a visual display or indicator button. An indicator button is simply a spring loaded tab, not shown, that extends outward from the solenoid valve when sufficient gas pressure is detected within the valve.

Upon exhaustion of the cylinder 50, the unit can be serviced with the change of the cylinder and a maintenance check of the float ball 30, to make sure no damage has occurred or build up of debris could otherwise impair further sealing. The solenoid 60 may include alarm mechanism to inform the consumer that the unit has been discharged and need of service. Such an indicator may be mechanical or electrical, either of which provides the intended notice of a spent gas cylinder 50 to be notified for purposes of maintenance.

A discharge light, not shown, may be attached to the solenoid coil to indicate that the solenoid 60 has been operated which indicates that the gas cylinder 50 is in need of replacement.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A condensate drain line purge device comprising:

a housing having a condensate inlet fluidly coupled to an outlet forming a chamber therebetween, said housing securable in an air conditioning condensate drain line;

a plug positioned within said chamber, said plug movable to an upper seat when condensate floods said chamber to seal said inlet and prevent condensate from flowing back through said inlet;

a solenoid valve having a gas inlet coupled to a disposable pressurized gas canister having a gas outlet fluidly coupled to said solenoid and said solenoid having an valve fluidly coupled to said housing chamber, said solenoid valve electrically coupled to a condensate holding pan float switch;

wherein condensate flows through said housing until a drain line clog occurs causing condensate to back up wherein the floating plug seals said condensate inlet and said solenoid valve is actuated by the float switch allowing pressurized gas into said chamber to purge the drain line of the clog.

2. The condensate drain line purge device according to claim 1 wherein said pressurized gas is contained within a threaded gas cartridge.

3. The condensate drain line purge device according to claim 2 wherein said gas cartridge is an 88 gram threaded $CO_2$ disposable cartridge.

4. The condensate drain line purge device according to claim 2 wherein said gas cartridge is a threaded 88 gram $N_2$ disposable cartridge.

5. The condensate drain line purge device according to claim 1 wherein said plug is a spherical ball that is constructed and arranged to float on water.

6. The condensate drain line purge device according to claim 1 wherein said chamber includes a lower seat adjacent said outlet, said lower seat holding said plug thereby allowing condensate to drain through said condensate inlet to said outlet.

7. The condensate drain line purge device according to claim 1 wherein said solenoid valve includes a pin for piercing a pressurized gas cartridge.

8. The condensate drain line purge device according to claim 1 wherein said condensate inlet is above said outlet wherein said housing is placed into a vertically positioned condensate drain line.

9. A condensate drain line purge device comprising:

a PVC housing having an condensate inlet fluidly coupled to an outlet forming a chamber therebetween, said housing securable in an air conditioning condensate drain line;

a spherical floating ball positioned within said chamber, said floating ball movable to an upper seat when condensate floods said chamber to seal said inlet and prevent condensate from flowing back through said inlet;

a solenoid valve having a gas inlet coupled to a pressurized disposable gas canister and an gas outlet coupled to said chamber, said solenoid valve including a pin for piercing said pressurized gas cartridge and a solenoid coil electrically coupled to a condensate holding pan float switch for releasing pressurized gas the coil is energized;

wherein condensate flows through said housing until a drain line clog occurs causing condensate to back up wherein the floating plug seals said condensate inlet and said solenoid valve is actuated by the float switch allowing pressurized gas into said chamber to purge the drain line of the clog.

10. The condensate drain line purge device according to claim 9 wherein said gas cartridge is an 88 gram threaded CO2 disposable cartridge.

11. The condensate drain line purge device according to claim 9 wherein said gas cartridge is a threaded 88 gram N2 disposable cartridge.

12. The condensate drain line purge device according to claim 9 wherein said chamber includes a lower seat adjacent said outlet, said lower seat holding said plug thereby allowing condensate to drain through said condensate inlet to said outlet.

13. The condensate drain line purge device according to claim 9 wherein said condensate inlet is above said outlet wherein said housing is placed into a vertically positioned condensate drain line.

14. The condensate drain line purge device according to claim 9 including an indicator to notify when the gas canister is not pressurized.

15. The condensate drain line purge device according to claim 9 including an indicator to notify when the gas canister is pressurized.

* * * * *